US008403778B2

(12) United States Patent
Wallach et al.

(10) Patent No.: US 8,403,778 B2
(45) Date of Patent: Mar. 26, 2013

(54) GAME BALL HAVING A BEVERAGE RECEPTACLE AND RAISED SYMBOL GRIPPING ASPECT

(76) Inventors: Allen Wallach, Fort Worth, TX (US); Andre Yanez, Fort Worth, TX (US)

( * ) Notice: Subject to any disclaimer, the term of this patent is extended or adjusted under 35 U.S.C. 154(b) by 214 days.

(21) Appl. No.: 12/826,155

(22) Filed: Jun. 29, 2010

(65) Prior Publication Data

US 2011/0009218 A1 Jan. 13, 2011

Related U.S. Application Data

(60) Provisional application No. 61/222,681, filed on Jul. 2, 2009.

(51) Int. Cl.
*A63B 43/00* (2006.01)

(52) U.S. Cl. ..... 473/613; 473/596

(58) Field of Classification Search ..... 473/594, 473/596, 597, 613; D21/707, 712, 713; 40/327
See application file for complete search history.

(56) References Cited

U.S. PATENT DOCUMENTS

| | | | | | |
|---|---|---|---|---|---|
| 1,438,165 | A | | 2/1924 | Eaton | |
| 1,483,165 | A | * | 2/1924 | Eaton | 473/281 |
| 2,705,148 | A | | 3/1955 | Waller | |
| 3,264,776 | A | | 8/1966 | Morrow | |
| 3,884,466 | A | * | 5/1975 | MacDonald et al. | 473/613 |
| 4,003,574 | A | * | 1/1977 | MacDonald et al. | 473/613 |
| 4,736,948 | A | * | 4/1988 | Thomas | 473/613 |
| 4,925,195 | A | | 5/1990 | DiManno | |
| 5,000,451 | A | * | 3/1991 | MacDonald et al. | 473/594 |
| 5,067,922 | A | * | 11/1991 | McMahon | 446/71 |
| 5,123,645 | A | * | 6/1992 | MacDonald et al. | 473/594 |
| 5,133,550 | A | | 7/1992 | Handy | |
| 5,152,709 | A | * | 10/1992 | Johnson et al. | 446/71 |
| 5,269,514 | A | | 12/1993 | Adler | |
| 5,284,341 | A | * | 2/1994 | Routzong et al. | 473/613 |
| 5,306,191 | A | * | 4/1994 | Phillips et al. | 446/61 |
| D351,971 | S | * | 11/1994 | Cappola | D7/625 |
| 5,397,261 | A | * | 3/1995 | Malewicki et al. | 446/71 |
| 5,450,979 | A | | 9/1995 | Servick | |
| 5,458,329 | A | * | 10/1995 | Bushman et al. | 473/613 |
| 5,460,368 | A | | 10/1995 | Pearson | |
| D386,229 | S | * | 11/1997 | Hicks | D21/712 |
| 5,807,198 | A | | 9/1998 | Grimm | |
| 5,833,897 | A | | 11/1998 | Grimm | |
| D402,198 | S | * | 12/1998 | Schultz et al. | D9/668 |
| 6,010,419 | A | * | 1/2000 | Rappaport et al. | 473/613 |
| 6,042,494 | A | | 3/2000 | Rappaport | |
| 6,045,469 | A | * | 4/2000 | Gleason et al. | 473/613 |
| 6,132,282 | A | * | 10/2000 | Camp | 446/124 |
| 6,220,918 | B1 | * | 4/2001 | Laronge | 446/63 |
| 6,612,577 | B1 | * | 9/2003 | Tiffin | 273/146 |
| D541,111 | S | * | 4/2007 | Morgan et al. | D7/625 |
| 7,261,638 | B2 | | 8/2007 | Davis | |
| 7,300,357 | B2 | | 11/2007 | Breaker | |
| D580,775 | S | * | 11/2008 | Harris | D9/668 |
| D623,905 | S | * | 9/2010 | Paslawski | D7/625 |
| D637,666 | S | * | 5/2011 | Erickson et al. | D21/712 |
| D639,360 | S | * | 6/2011 | Lederman et al. | D21/712 |
| 2008/0039250 | A1 | * | 2/2008 | Martino | 473/613 |

* cited by examiner

*Primary Examiner* — Steven Wong
(74) *Attorney, Agent, or Firm* — Decker, Jones et al.; Brian K. Yost; Geoffrey A. Mantooth

(57) ABSTRACT

A game ball as provided having a central passage capable of holding a beverage container and an elongated raised symbol gripping portion. The central passage is circular in shape and uniform in diameter and shares a longitudinal axis with the game ball. In one aspect of the invention, the game ball may be used as an insulated beverage container receptacle and is comprised of central fins that define the base for which the container may rest. The raised symbol gripping portion allows a user to impart rotational movement, or spiral action, when a ball is thrown.

14 Claims, 3 Drawing Sheets

GAME BALL HAVING A BEVERAGE RECEPTACLE AND RAISED SYMBOL GRIPPING ASPECT

This application claims the benefit of U.S. provisional application Ser. No. 61/222,681, filed Jul. 2, 2009, the contents of which are incorporated by reference herein its entirety.

BACKGROUND OF THE INVENTION

1. Field of the Invention

The present invention relates generally to a throwing object and specifically to a game ball having a beverage receptacle and raised symbol gripping aspect.

2. Description of the Prior Art

Within the United States of America as well as other parts of the world, a popular activity enjoyed by millions is tossing an object such as a football, beach ball, Frisbee®, or baseball. For example, persons relaxing at a picnic or at the beach may enjoy throwing a football. While most people enjoy throwing it, some find it difficult to impart the spiral rotation necessary to accurately throw a conventional football a sufficient distance. Because only a limited portion of the population possess the skills required to throw a conventional football proficiently, various modifications have been made to such footballs to allow a greater portion of the population to throw a football shaped object better. For example, U.S. Pat. No. 5,269,514 issued to Adler et al. discloses a football shaped object having external fins that promote rotation in flight. U.S. Pat. No. 3,884,466 issued to McDonald, et al, discloses a game ball with a hollow portion with a weighted insert. U.S. Pat. No. 5,133,550 issued to Handy discloses a football having raised ribs extending asymmetrically along the length of the body which ribs change the aerodynamic properties of the football when thrown. U.S. Pat. No. 4,736,948 issued to Thomas discloses a football with a hollowed center passage and a pair of wind fins mounted within the passage. U.S. Pat. No. 5,458,329 issued to Bushman discloses a football shaped game ball with a cylindrical hole with external fins to aid in spinning the ball. U.S. Pat. No. 5,004,451 issued to McDonald discloses a football with a weighted center passage. U.S. Pat. No. 5,460,368 issued to Pierson teaches a lightweight ball projectile with a center passage and cutout design patterns along the body to cause an erratic flight path.

After a period of time of throwing a football or similar projectile as those describe above, the now tired or perhaps distracted participants may desire to change activities and enjoy a beverage. Because many outdoor activities are enjoyed during warm weather, individuals sometimes store beverages in insulated chests, or coolers, to keep their drinks cold. After removing the beverage from the cooler, some individuals desire to place their beverage in an insulated beverage holder known popularly as a "Koozie®". Insulated beverage holders have been used for years as advertising tools because such holders are generally inexpensive to manufacture and additionally offer a suitable and promotionally desirable surface for placement of marketing messages such as a brand names, slogans, or logos. Despite having further marketing capabilities, most insulated beverage holders are single purpose objects and are used only to insulate a beverage container. Limited attempts have been made to broaden the uses of insulated beverage holders. For example, Gleason, U.S. Pat. No. 6,045,469 teaches a tubular throwing projectile having an elongated body and an axial hole configured to accept a beverage container.

While some football shaped throwing objects with central passages capable of holding a beverage are known in the art, none of these prior art throwing objects incorporate the feature of having a raised symbol gripping portion. What is needed is a game ball that addresses the need of marketers looking for new marketing opportunities and the need of outdoor enthusiasts who desire the experience of more proficiently throwing a football-like object that may also be used as a beverage receptacle. The present invention provides for these needs by providing a game ball that may be used as a beverage receptacle, the ball having superior aerodynamic properties and a raised symbol gripping portion that offers enhanced marketing opportunities.

The present invention provides a game ball shaped generally like a truncated football. The ball is comprised of a central passage capable of holding a beverage container and an elongated raised symbol gripping portion. The central passage is of circular shape and uniform diameter through the length of the ball with the longitudinal axis of the passage lying on the longitudinal axis of the ball. In one aspect of the invention, the central passage is comprised of an open portion and a central fin assembly portion. In this aspect of the invention, when used as a beverage container receptacle, the fin portion of said central passage acts as a base against which the container may rest. The raised symbol gripping portion allows a user to impart additional rotational movement, or spiral action, when the ball is thrown.

When thrown, the game ball of the present invention will rotate about a longitudinal axis to form a spiral just as a perfectly thrown conventional football would. However, the truncated shape of the ball, together with the central passage comprised of fins, and the gripping portion allow a user to impart virtually the same spiral on a less than perfectly thrown ball as one thrown correctly.

While the gripping portion comprised of raised symbols may be used by the thrower to impart an even greater spiral action on the ball than would otherwise be imparted in the absence of such portion, the gripping portion has the added function of being capable of being comprised of a marketing message such as a company name, brand, or logo. Because of its incorporation within a functional aspect of the ball, the message will be even more greatly appreciated by the user. Since it is expected that the game ball of the present invention will likely be used at picnics and family gatherings at which numerous consumer products are being used and consumed, the ball has valuable marketing potential. For example, a beverage company may like to use the ball to promote the consumption of its beverages at social functions and can place its company name or logo along the gripping portion of the game ball. Therefore, the consumer would be reminded of the company's product when the ball is at rest, being thrown, or being used to hold and insulate a beverage container.

SUMMARY OF THE INVENTION

The present invention provides a truncated prolate or football shaped game ball. The ball is comprised of a body having a prolate shape, a central passage, and a gripping portion. The central passage is comprised of an open portion and a central fin assembly portion. When used as a beverage container receptacle, the fin portion of said central passage acts as a base against which the container may rest. When thrown, the game ball of the present invention will rotate about a longitudinal axis to form a spiral just as a perfectly thrown conventional football would. However, the truncated shape of the ball, together with the central passage and the gripping portion allow a user to impart virtually the same spiral on a less than perfectly thrown ball as one thrown correctly.

In one aspect of the present invention, the central passage is capable of holding a beverage container.

In one aspect of the present invention, the central passage is comprised of an open space and a central fin assembly.

In one aspect of the present invention, the gripping portion is comprised of raised symbols. In this aspect of the invention, the gripping portion comprised of raised symbols may used to impart rotational movement of the ball about its longitudinal axis.

In another aspect of the present invention, the raised symbols are capable of conveying a marketing message.

In another aspect of the present invention, the marketing message is a company name.

In another aspect of the present invention, the marketing message is a brand name.

In another aspect of the present invention, the marketing message is a logo.

In another aspect of the present invention, the game ball has one or more seams.

In another aspect of the present invention, the game ball has an outer surface that has a pigskin appearance.

DESCRIPTION OF THE PREFERRED EMBODIMENT

Figure 1:
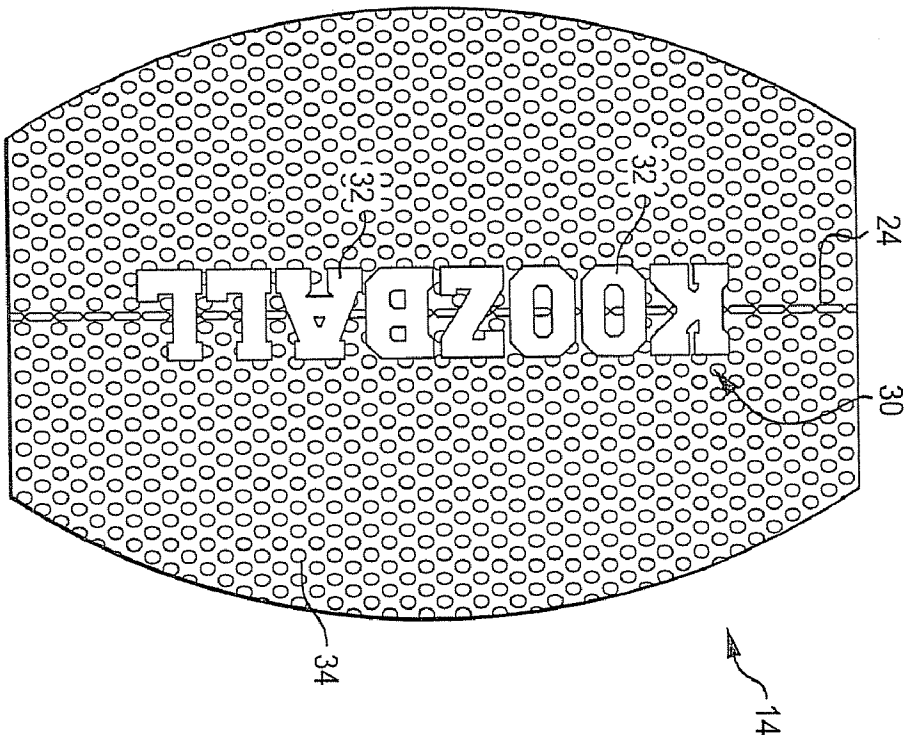
FIG. 1 is a side elevation view of the game ball of the present invention, in accordance with a preferred embodiment.
Figure 2:
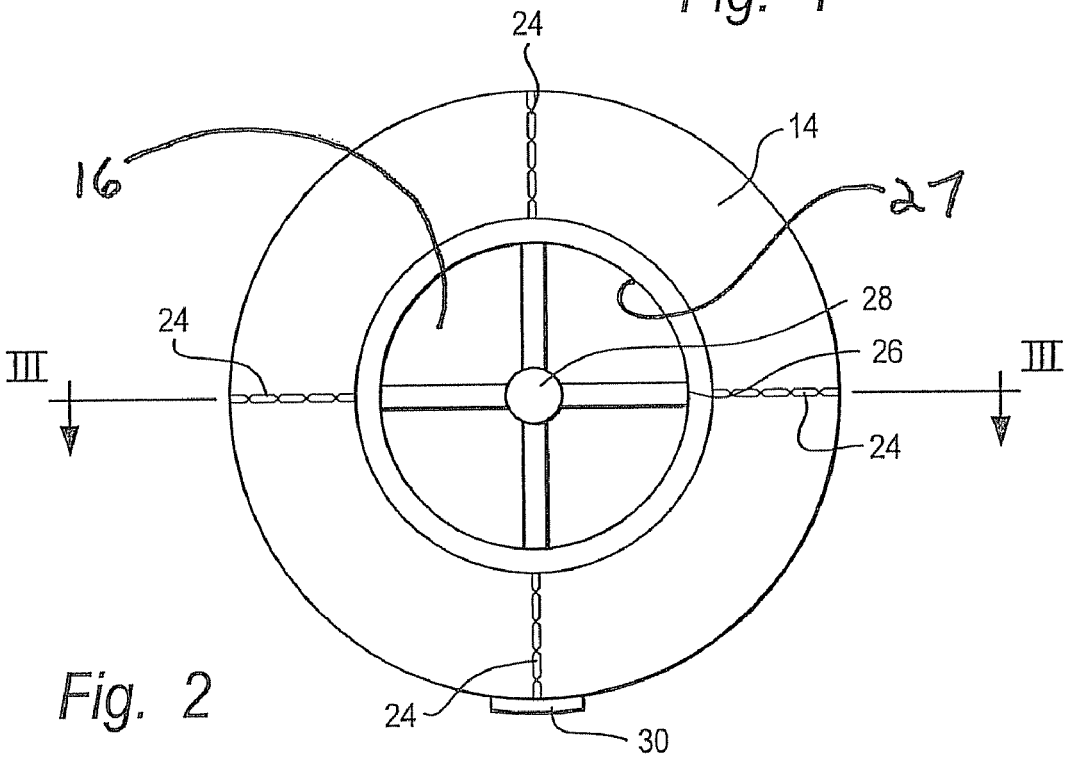
FIG. 2 is a top elevation view of the game ball of the present invention in accordance with a preferred embodiment.
Figure 3:
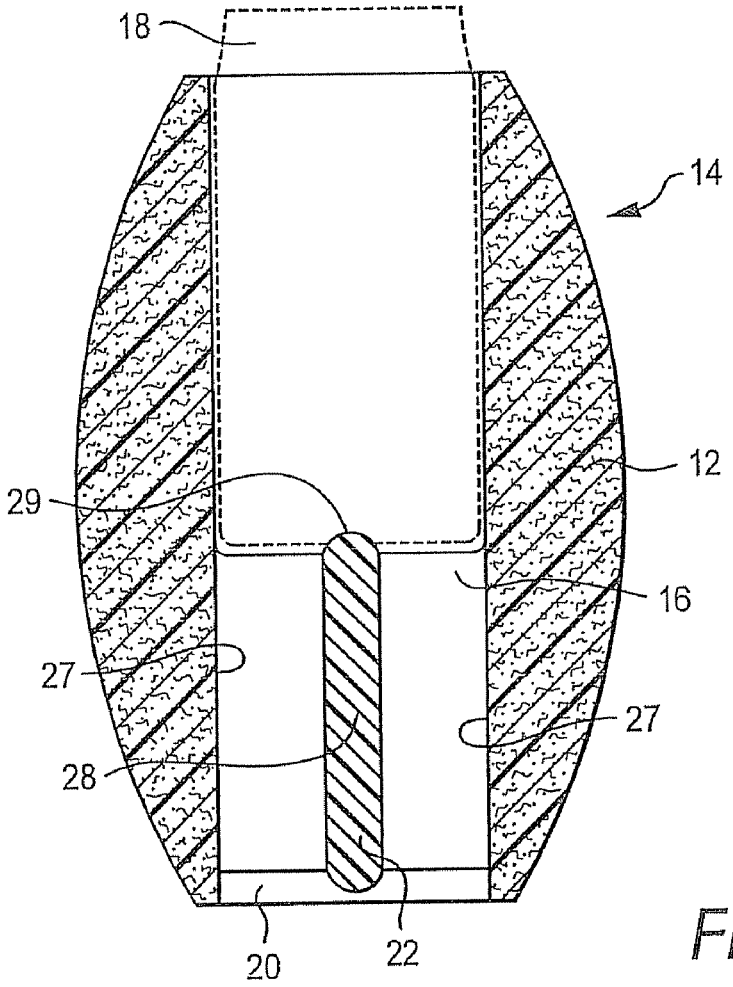
FIG. 3 is a cross-sectional view taken along the lines III-III of FIG. 2 with a beverage container shown in phantom in accordance with a preferred embodiment.

Referring to FIGS. 1-5, there is shown a game ball having a beverage receptacle and raised symbol gripping aspect. Referring to FIG. 1-3, the ball 14 is comprised of a body 12 having a prolate shape, a central passage 16, and a gripping portion 30. In a preferred embodiment, the central passage 16 is of circular shape and uniform diameter through the length of the ball 14 with the longitudinal axis of the passage 16 lying on the longitudinal axis of the ball 14. However, the central passage 16 need not be uniform in diameter. For example, the central passage 16 may have a venturi-like configuration with a point of constriction within the length of the passage 16. As will be discussed in more detail below, in another embodiment of the invention, the central passage 16 is comprised of an open portion 20 and a central fin assembly 22. In this embodiment, the central fin assembly 22 acts as an aerodynamic stabilizer. When used as a beverage container 18 receptacle, the fin assembly portion 22 of said central passage 16 acts as a base 29 against which the container 18 may rest. When thrown, the game ball 14 of the present invention will rotate about a longitudinal axis to form a spiral just as a perfectly thrown conventional football would. However, the truncated shape of the ball 14, together with the central passage 16 and the gripping portion 30 allow a user 38 to impart virtually the same spiral on a less than perfectly thrown ball 14 as one 14 thrown correctly.

In the preferred embodiment, the game ball 14 is formed of a resilient insulating foam material. In this embodiment, the ball 14 is molded from a single piece of material. However, the ball 14 may alternatively be formed from a plurality of pieces and a variety of materials. For example, the ball 14 may be formed from rubber or plastic, and the like, and may be manufactured using a variety of standard manufacturing methods such as injection molding, extrusion, or blow molding.

In one aspect of the present invention, the central passage 16 is capable of holding a beverage container 18. Referring to FIG. 3, a beverage container 18 may be inserted in such passage 16. Because of the insulating qualities of the material from which the game ball 14 is manufactured, a beverage within such a container 18 will maintain its temperature longer while inserted in the receptacle 16.

Figure 4:
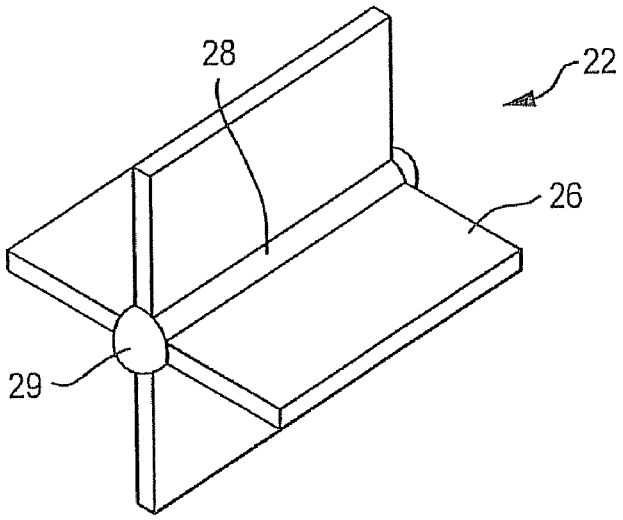
FIG. 4 is an isometric view of the central fin assembly of the present invention in accordance with a preferred embodiment.

In one aspect of the present invention, the central passage 16 is comprised of an open space 20 and a central fin assembly 22. Referring to FIGS. 2-4, the central fin assembly 22 is comprised of a post 28 from which a plurality of fins 26 extend radially to the walls 27 of the central passage 16. In the preferred embodiment, there are four fins 26. However, virtually any number of fins 26 may be used without departing from the spirit of the invention. The post 28 is located in the center of the central passage 16 such that the longitudinal axis of the post 28 lies along the longitudinal axis of the ball 14. In the preferred embodiment, the fin assembly 22 is nearer to the lower portion of the central passage, as shown in FIG. 3. The fin 26 has a base 29 upon which a beverage container 18 may rest. This base 29 is the upper portion of the post 28.

Referring to FIG. 1, in one aspect of the present invention, the gripping portion 30 is comprised of raised symbols 32. In this aspect of the invention, the gripping portion 30 comprised of raised symbols 32 may be used to impart greater rotational movement about a longitudinal axis than would otherwise be imparted in the absence of such a raised symbol portion 30. In the preferred embodiment, these symbols are raised approximately ⅛" from the surface 34 of the ball 14.

In another aspect of the present invention, the raised symbols 32 are capable of conveying a marketing message such as a brand name, slogan, or logo. For example, and as shown in FIG. 1, the raised symbols 32 form the word KOOZBALL™. However, the symbols 32 need not form the name KOOZBALL™. Rather, virtually any combination of symbols, marks, or designs may be incorporated for use in the gripping portion 30.

In another aspect of the present invention, the game ball 14 has one or more seams 24. In the preferred embodiment, the game ball 14 is molded from a single piece of material. Therefore, in this embodiment, there is no juncture between analogous structural elements which form the seam on a conventional football. However, a simulated seam 24, is incorporated in this embodiment of the invention. This simulated seam 24 replicates the conventional football seam and is comprised of a slight depression in the outer surface 34 of the ball 14 that extends longitudinally along the surface 34 from the top portion of the ball 14 to the lower portion. In the preferred embodiment, there are four such simulated seams 24 that roughly divide the outer surface 34 of the ball 14 into four quadrants, as shown in FIG. 2.

In another aspect of the present invention, the game ball 14 has an outer surface 34 that has a pigskin appearance. Referring to FIGS. 1 and 3, this surface 34 is comprised of small dimples that resemble the dimpling pattern found on a convention football. Although a preferred embodiment of the invention has an outer surface 34 with a pigskin appearance, the outer surface 34 need not have such an appearance. Rather, without departing from the spirit and meaning of the invention, the surface 34 may have a number of different type textures. For example, the outer surface 34 may be smooth or have large dimples like oversized versions of those found on a golf ball. The outer surface 34 may also have a slip resistant surface to make the ball 14 easier to throw or catch, especially in inclement weather conditions.

Figure 5:
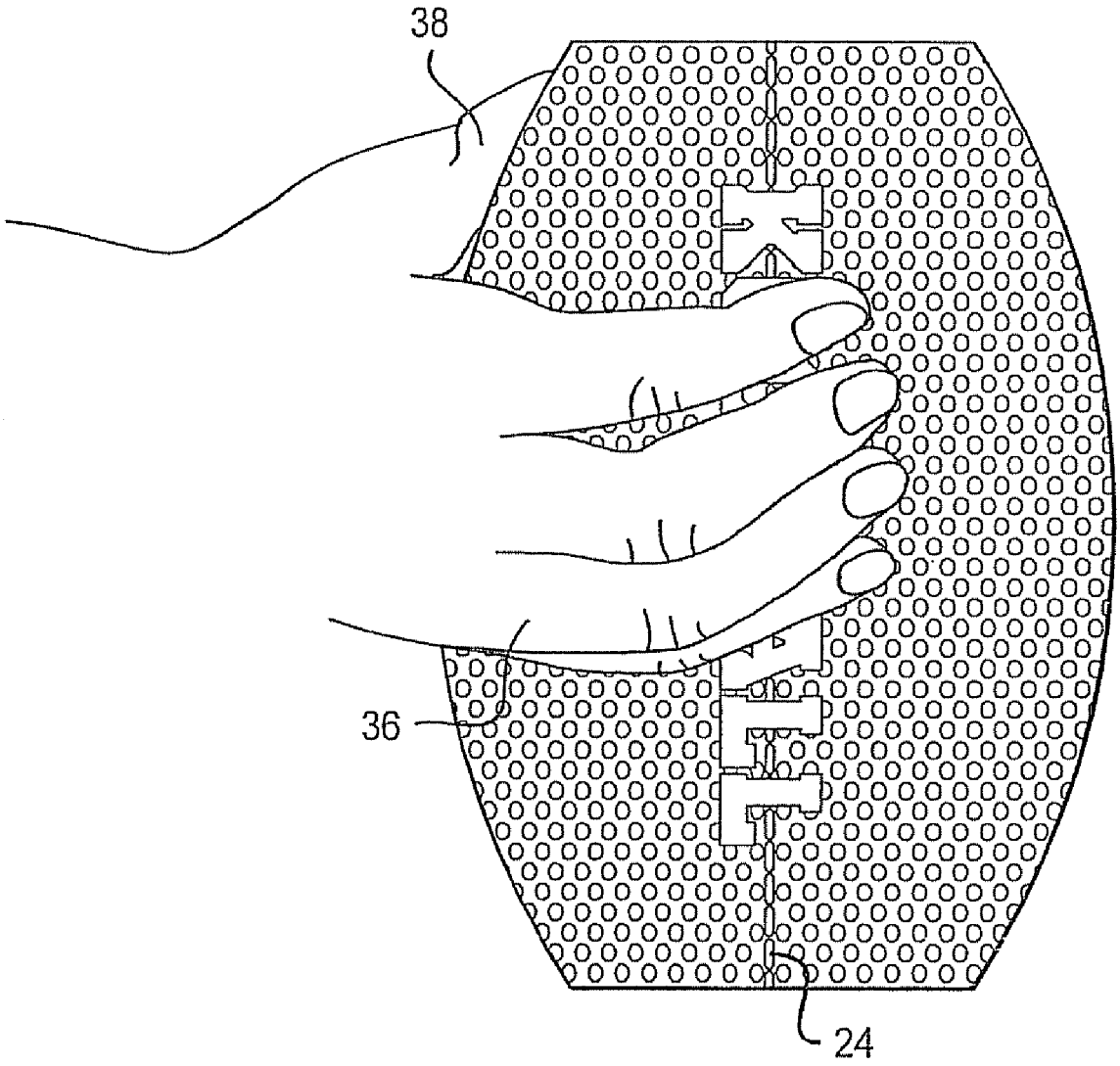
FIG. 5 is a side elevation view of the game ball together with a user's hand.

The operation and use of the game ball 14 will now be described. The user 38 grasps the ball as shown in FIG. 5, with the first four fingers 36 of the throwing hand overlapping the gripping portion 30 and the thumb 38 grasping the surface of the ball 14 such that when the ball 14 is thrown, the receptacle portion of the central passage 16 is closest to a selected target than the central fin assembly portion 22 of the central passage 16. The user 38 then throws the ball 14 towards the target such that the central passage 16 is aligned with the intended direction of flight. When used as a beverage container 18 receptacle, the fin assembly portion 22 of said central passage 16 acts as a base 29 against which the container 18 may rest. When thrown, the game ball 14 of the present invention will rotate about a longitudinal axis to form a spiral just as a perfectly thrown conventional football would. However, the truncated shape of the ball 14, together with the central passage 16 and the gripping portion 30 allow a user 38 to impart virtually the same spiral on a less than perfectly thrown ball 14 as one 14 thrown correctly.

While there has been illustrated and described what is, at present, considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of the claims.

We claim:

1. A game ball comprising a prolate shaped body comprising a wall comprising an inner and outer surface, the ball further comprising a central passage defining a through opening, said passage and ball each comprising a central longitudinal axis, said axes being the same, said outer surface comprising flat leading and trailing surfaces, said leading and trailing surfaces each being positioned on a respective plane, said respective planes being perpendicular to said central longitudinal axis, said central passage comprising a central fin assembly, said central fin assembly comprising a hub and a plurality of fins radiating outwardly from said hub to said inner surface, and wherein said central passage is adapted to receive a beverage container.

2. The game ball of claim 1, wherein said central fin assembly is positioned between a midpoint and said trailing surface, said midpoint being positioned midway between said leading and trailing surfaces.

3. The game ball of claim 2 wherein said central fin assembly comprises a base, said base comprising a flat base leading edge positioned on a plane perpendicular to said longitudinal axis, said flat base leading edge being adapted for said beverage container to rest.

4. The game ball of claim 3 wherein said wall is insulated.

5. The game ball of claim 1 wherein said surface is slip resistant.

6. The game ball of claim 1 wherein said surface comprises a pattern.

7. The game ball of claim 6 wherein said pattern is a dimpled pattern.

8. The game ball of claim 6 wherein said pattern is a pigskin pattern.

9. The game ball of claim 1 wherein said outer surface comprises one or more seams.

10. The game ball of claim 1 wherein said wall is cushioned.

11. The game ball of claim 1 comprising raised symbols comprising a marketing message.

12. A game ball comprising a prolate shaped body having an insulated and cushioned wall, said wall having an outer surface, a through opening defining a central passage adapted to receive a beverage container, said passage and ball each comprising a central longitudinal axis, said axes being the same, said outer surface comprising flat leading and trailing surfaces, said leading and trailing surfaces each being positioned on a respective plane, said respective planes being perpendicular to said central longitudinal axis, said central passage comprising a central fin assembly, said central fin assembly comprising a plurality of fins radiating outwardly to said inner surface, and a gripping portion comprising one or more raised symbols, said body and passage each having a central longitudinal axis, said axes being the same;

said central fin assembly being positioned between a midpoint and said trailing surface, said midpoint being positioned midway between said leading and trailing surfaces;

and wherein said outer surface is slip resistant and comprises a pigskin pattern.

13. The game ball of claim 12 wherein said raised symbols comprise a marketing message.

14. The game ball of claim 12 wherein said central fin is a base for said beverage container to rest.

* * * * *